United States Patent [19]

Scharf

[11] 4,105,374

[45] Aug. 8, 1978

[54] INTEGRATED MULTI-UNIT REFRIGERATION MOTOR-COMPRESSOR ASSEMBLY

[75] Inventor: Philip H. Scharf, Dayton, Ohio

[73] Assignee: Copeland Corporation, Sidney, Ohio

[21] Appl. No.: 781,792

[22] Filed: Mar. 28, 1977

[51] Int. Cl.[2] ..... F04B 17/04; F25B 31/02

[52] U.S. Cl. ..... 417/415; 417/312; 417/426; 417/902; 62/296; 62/508

[58] Field of Search ..... 417/312, 363, 415, 426, 417/902; 62/296, 508, 510

[56] References Cited

U.S. PATENT DOCUMENTS

| | | | |
|---|---|---|---|
| 2,663,164 | 12/1953 | Kurtz | 417/902 |
| 2,747,377 | 5/1956 | Lowensohn | 62/510 |
| 3,205,674 | 9/1965 | Arnold et al. | 62/510 |
| 3,503,223 | 3/1970 | Parker | 62/510 |
| 3,775,995 | 12/1973 | Conley et al. | 62/510 |
| 3,785,169 | 1/1974 | Gylland, Jr. | 62/510 |

*Primary Examiner*—C. J. Husar

*Attorney, Agent, or Firm*—Harness, Dickey & Pierce

[57] ABSTRACT

Two motor-compressor units of the vertical shaft type are housed in spaced parallel relation in a common sealing housing. A hollow chambered partition extends transversely within the housing between the units and is attached to the side walls and top wall but spaced from the bottom wall. The partition functions as a suction gas header, substantially isolates the suction areas above the oil level, and stiffens the housing walls, inhibiting resonant vibration.

16 Claims, 5 Drawing Figures

INTEGRATED MULTI-UNIT REFRIGERATION MOTOR-COMPRESSOR ASSEMBLY

BACKGROUND OF THE INVENTION

Modern refrigeration motor-compressor units are being used in many applications wherein it is advantageous to vary the output in accordance with transient load changes. Many types of unloading systems have been proposed and employed in connection with multi-cylinder compressors, for selectively disabling one or more cylinders while one or more other cylinders remain operative, in order to control the output. Systems have also been employed incorporating, in place of a single unit large enough to carry the maximum load, a plurality of smaller motor-compressor units having a combined output equal to the required maximum, with means for controlling the total system in such manner as to selectively activate and deactivate less than all the compressors when it is desired to vary the output. Incorporation of a plurality of such smaller units in a single hermetic housing has also been proposed. Although such multi-unit systems are more efficient than the larger single units, in the sense that modulation can be effected without loss of efficiency, and the multi-unit arrangements can also be lower in cost, certain disadvantages have militated against their general use.

The overall object of the present invention is to provide an improved multi-unit refrigeration motor-compressor assembly incorporated in a unitary sheet metal housing and so designed that standard motor-compressor units of proven design can be employed, the arrangement being such that the housing provides a common oil sump for all units and a compartment thereabove for each unit, such compartments being substantially isolated from each other above the oil lvel but communicating with a common suction line through which gas is returned to both units from the evaporator means. Two important attributes sought by the designers of modern refrigeration equipment are compactness and quiet operation. When a plurality of motor-compressor units of a standard type are installed in their conventional upright operative position in a single sheet metal housing, it becomes necessary to so shape the housing, in order to minimize space consumption, that relatively flat walls of substantial size exist which, unless effectively stiffened or cushioned by special noise-inhibiting means, are capable of resonant vibration which tends to create objectionable noise. It will be appreciated that many methods of inhibiting noise which might readily occur to the designer would entail either a substantial increase in cost or increased size of the unit itself. For example, heavy-walled cast and/or ribbed enclosures, brazing, insulating covers, and such standard practices which might constitute obvious engineering answers to the problem involve undesirable penalties in cost and/or compactness.

In accordance with the present invention, upright motor-compressor units of types which are produced in large volume on automated production lines can be employed, and are arranged in essentially conventional fashion in the normal vertical position and relatively close together. A single sheet metal housing is fitted closely around the two units and is substantially oval in horizontal section, the side walls being flat. The central portions of the flat side walls are rigidly connected and effectively braced throughout substantially their full vertical height by a hollow chambered partitioning and stiffening member which also serves as a suction gas header or accumulator and which occupies space which would otherwise be largely unused. The partitioning member is effective to stiffen and damp resonant vibration of the side and top walls of the housing.

It will be understood from the foregoing that the objects of the invention also include the reduction of cost, noise and space, while preserving the virtues and benefits of proven designs and of proven, established manufacturing facilities and processes.

Other objects and advantages will become apparent upon consideration of the present disclosure in its entirety.

BRIEF DESCRIPTION OF THE FIGURES OF DRAWING

DETAILED DESCRIPTION OF THE PREFERRED FORM OF THE INVENTION

Figure 1:
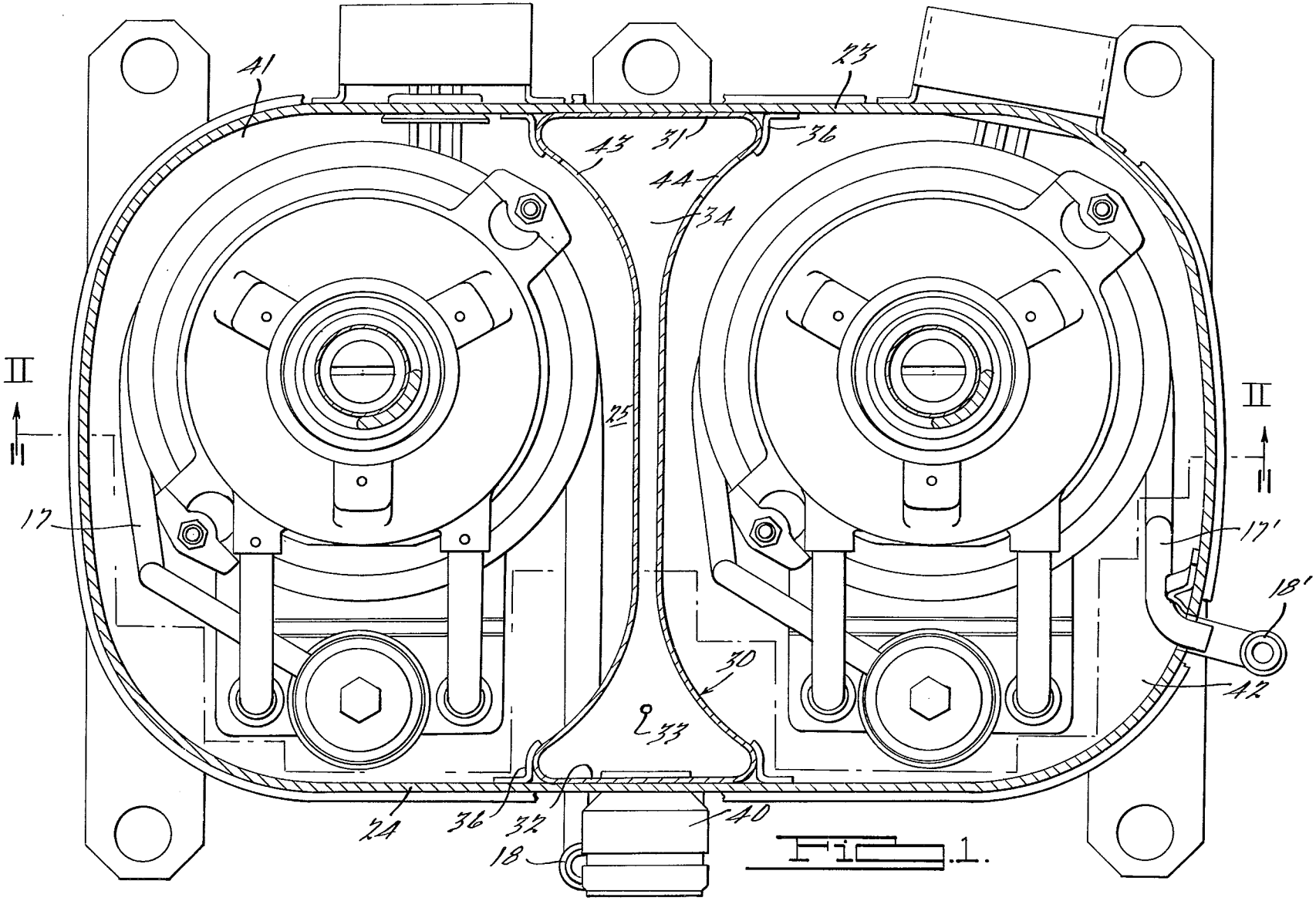
FIG. 1 is a view corresponding to a horizontal sectional plan of a multi-unit motor-compressor assembly incorporating the present invention, taken directly under the top wall.
Figure 2:
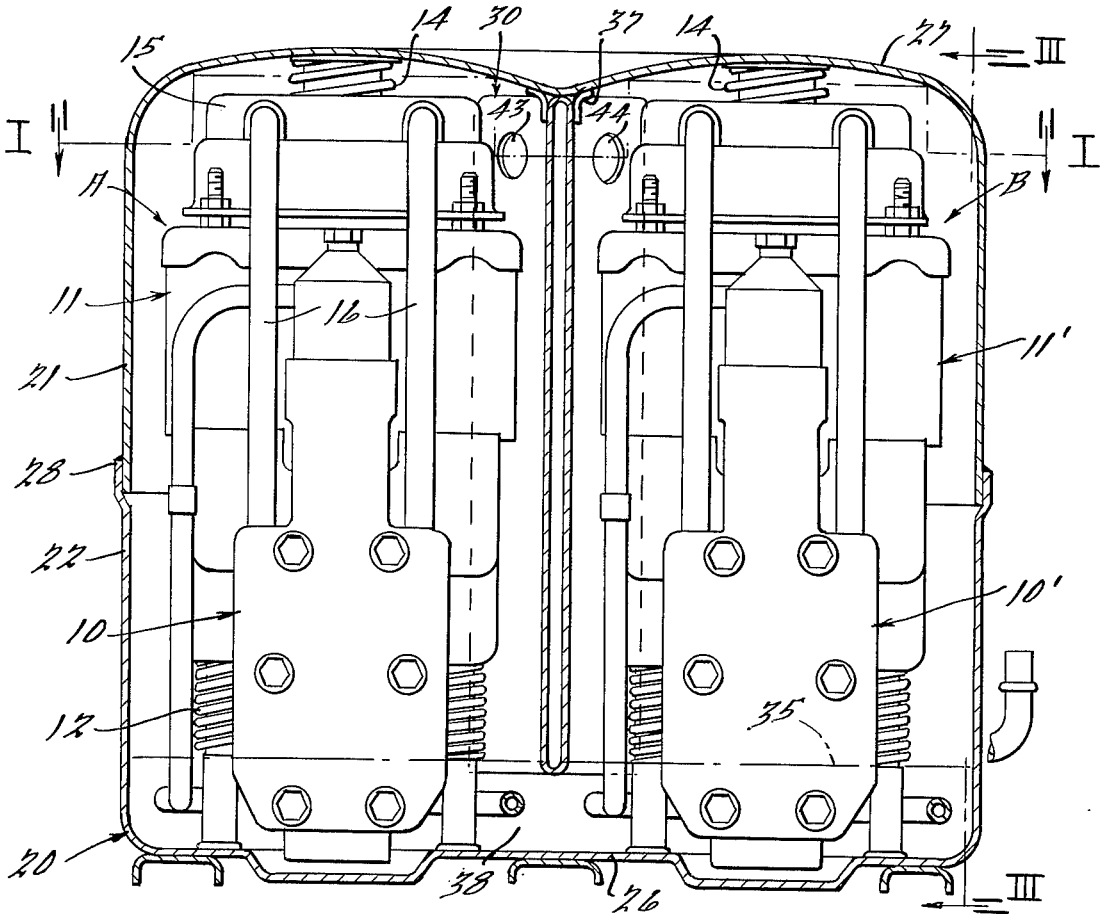
FIG. 2 is a vertical sectional elevational view taken substantially on the line II—II of FIG. 1 and looking in the direction of the arrows.
Figure 3:
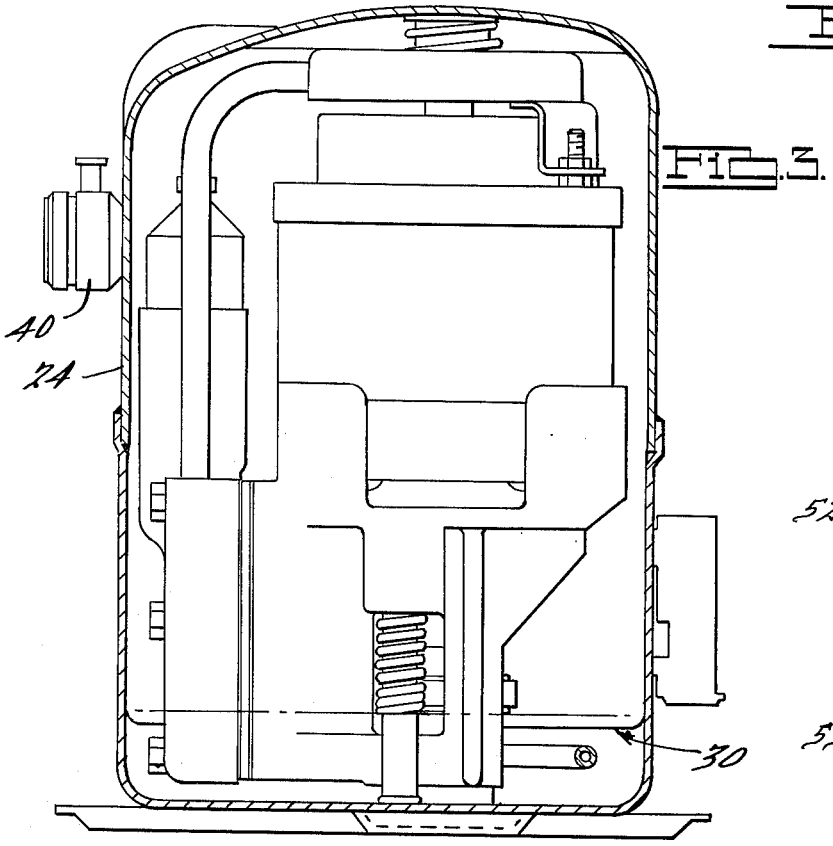
FIG. 3 is a section taken substantially on the line III—III of FIG. 2 and looking in the direction of the arrows.

Reference characters A and B designate generally a pair of motor-compressor units which are shown as of a conventional type well known in the trade intended for operation in a vertical position, the compressor portions as 10, 10' of the respective units being at the bottom, and the driving electric motors 11, 11' thereof being at the top. Such units are designed for installation in a housing the interior of which is at suction pressure, and are normally installed in individual housings of welded sheet metal construction having walls which are substantially rounded throughout. Such conventional individual housings are and have been developed to be relatively noise-free, the rounded contours effectively inhibiting resonant vibration of the housing walls.

The specific nature and details of construction of the motor-compressor units do not form a part of the present invention, and it will be recognized that the invention is applicable to various known types of motor compressor units. Each unit is preferably supported and positioned within the housing by suitable resilient mounting springs as 12, 14 and is designed to draw suction gas from the space within an upper portion of the housing through a combined inlet and separator assembly as 15, the details of which are also known and form no part of the present invention. The suction gas is delivered from the inlet separator to the compressor via suction tubes 16, and discharge gas is delivered from each compressor to a discharge fitting 18, 18' which extends through a wall of the housing to the exterior.

The housing, generally designated 20, is formed in telescopically interfitted and welded upper and lower cupped sheet metal sections 21, 22 respectively, which will be recognized as formed, interfitted and secured together at a medial flanged and welded area 28 in a manner which is essentially conventional in the trade. However, in order to accommodate the multiple compressors, the housing is substantially elongated in a horizontal dimension, and the elongated side walls 23, 24 are substantially flat. As shown in FIG. 1, the housing is fitted closely around the units, the amount of clearance being substantially that which is regarded as conventional, namely sufficient to permit rocking and vibration of the units on their spring mountings without danger of striking the housing.

The space 25 between the two units is extended slightly, for example, the units may be spaced ½ inch farther apart than the normal minimum required spacing between adjacent units, clearance thereby being provided for a transverse hollow chambered partitioning member, generally designated 30, which is also formed of sheet metal, and can be described as of modified dumbell-shaped contour in horizontal section. As shown in FIG. 1, the partitioning member extends vertically and transversely between the flat walls 23, 24, and perpendicularly thereto. The end walls 31, 32 of the partitioning member are flattened and fitted tightly against the inner surfaces of the walls 23, 24 and attached thereto by means of welded angle brackets 36. The partitioning member extends substantially the full vertical height of the interior, although its lower extremity is spaced above the bottom wall 26 so that the two interior compartments 41, 42 within the housing for the respective units A and B are substantially isolated by the partitioning member 30, except in the area below the bottom of the partitioning member. The system is designed to have a normal oil level, indicated by broken line 35, which is above the bottom of the partitioning member. Thus the portion of the housing below the partitioning member defines a common oil sump area 38 extending the full distance beneath both of the units A and B. It will be recognized that although the partitioning member is shown and referred as having its lower extremity spaced above the bottom wall 26, references thereto in the specification and claims are intended to encompass an equivalent construction wherein the partitioning member, although extending all the way to the bottom, is provided with apertures, unconnected to the interior of the partitioning member, to provide cross-communication between the oil sump areas beneath the two units. The top of the partitioning member is also fitted to the top wall 27 and rigidly attached thereto as by welded angle brackets 37, and the partitioning member thus substantially isolates the two compressor compartments in the area above the oil sump.

Inasmuch as the units A, B are approximately circular in horizontal section, a longitudinally extended area is available near the side walls 23, 24, and the portions of the partitioning member 30 close to such walls are expanded to substantially occupy the enlarged available space, thereby providing a relatively large space within the partitioning member which is effectively employed as a suction gas accumulator or header. A common suction gas inlet coupling 40 is secured to and opens through the abutting wall portions 32, 24, and return gas for both of the units A and B is introduced through the coupling 40, flows into the chamber 34 within the partitioning member, and is delivered laterally into the compartments 41, 42 for the units A and B respectively, above the oil level in such compartments, through orifices 43, 44 in the side walls of the partitioning member, the interior of the partitioning member being otherwise fully enclosed, except for a hole 33 in the bottom of the partitioning member which permits any oil contained in the suction gas to return to the sump.

The partitioning member is formed of sheet steel of a thickness and stiffness sufficient to effectively brace the walls 23 and 24 and prevent them from vibrating at audible frequencies when the compressors are operating. The top wall 27 is similarly effectively damped by its attachment to the partitioning member. Although, as indicated, the partitioning member could if desired be similarly tied to the bottom wall 26, it will be recognized that in most designs, such as the one illustrated, the contouring and other stiffening features existing in the bottom wall construction will make this unnecessary.

Figure 5:
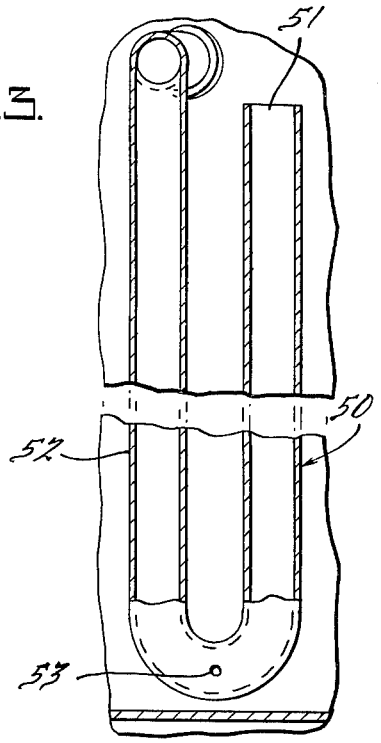
FIG. 5 is a fragmentary sectional detail view taken on the line V—V of FIG. 4 and looking in the direction of the arrows.
Figure 4:
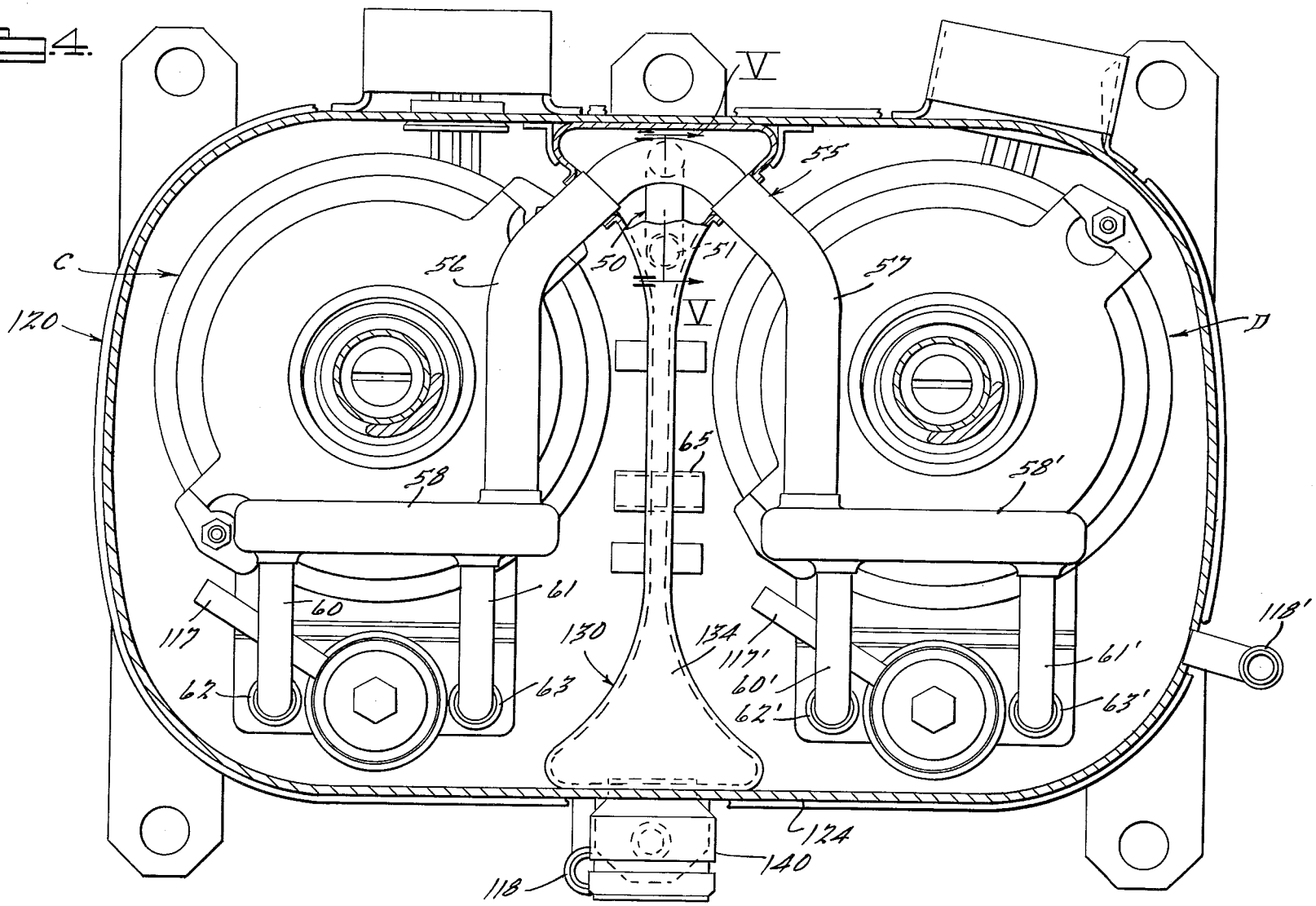
FIG. 4 is a view similar to FIG. 1 showing a modified construction.

As shown in FIGS. 4 and 5, the invention is also readily applicable to constructions of the type wherein the interior of the housing is at high side pressure. In this embodiment two motor-compressor units, C and D are shown in plan, similarly positioned in a housing 120, the construction of which may be similar to that of housing 20 of the first embodiment. Parts corresponding to those already disclosed are designated by corresponding reference numerals 100 integers higher, and many will not require redescription.

Each compressor discharges directly into the housing, as through discharge pipes 117, 117', and the housing in turn opens directly into discharge fittings 118, 118', which are shown as provided on opposite sides of the partitioning member 130. Although two discharge fittings are shown in order to minimize any back pressure which might result from the presence of the partitioning member, it will be recognized that if the partitioning member is sufficiently spaced from the bottom of the housing, a single discharge fitting may suffice. In addition, cross-communication between the respective compartments 141, 142 is preferably provided by a through tube 65 which extends transversely through the partitioning member 130 near the top and is sealed to the walls thereof to maintain the sealed integrity of the suction accumulator chamber 134 therein.

The partitioning member 130 is shaped, positioned and attached similarly to partitioning member 30, and is similarly constructed, except for the elimination of the holes 33, 43, 44. The suction fitting 140 for the return line (not shown) opens through the side wall 124 into one end of the partitioning member 130. Near the other end of the partitioning member a J-tube 50 is provided having an open mouth 51 near but spaced from the top of the chamber 134. The upper end of the other leg 52 of the J-tube is secured to and supported by and communicates interiorly with the bight portion of a horizontal U-tube 55, the two legs 56, 57 of which extend outwardly through and in sealed relation to the opposite side walls of the partitioning member 130. Leg 56 leads to a suction manifold-muffler 58 connected by conduits 60, 61 to the suction port portions 62, 63 of compressor unit C. Leg 57 similarly leads to manifold-muffler 58' connected by conduits 60', 61' to suction port portions 62', 63' of compressor unit D. Conduit portions 60, 60', 61, 61' are flexible enough to permit normal movements of units C and D, and may of course be looped sufficiently to prevent any overstressing.

A metering orifice 53 in the bottom of the J-tube 50 limits the rate at which any liquid in the bottom of the accumulator chamber 134 can be drawn into a compressor.

It will be appreciated that additional units may similarly be incorporated in a further extended housing construction which can, applying the same principles, incorporate three or more units similar to the units A and B, or C and D, with partitioning members corresponding to the member 30 or member 130 between each pair of adjacent units, and it will be understood that other variations may be adopted without departing from the fair and proper scope of the appended claims.

This Detailed Description of Preferred Forms of the Invention, and the accompanying drawings, have been furnished in compliance with the statutory requirement to set forth the best mode contemplated by the inventor of carrying out the invention. The prior portions consisting of the "Abstract of the Disclosure" and the "Background of the Invention" are furnished without prejudice to comply with administrative requirements of the Patent and Trademark Office.

What is claimed is:

1. A hermetic multi-unit refrigeration motor-compressor assembly comprising in combination with a sealed metallic housing having top, bottom and side walls, a pair of motor-compressor units in spaced parallel relation in the housing, characterized by a partitioning member extending transversely within the housing between said units to define two compartments, each of which contains one of said units, the partitioning member being affixed to the side walls and top wall but substantially spaced above the bottom wall of the housing, whereby the bottom portion of the housing defines a common oil sump area.

2. An assembly as defined in claim 1 wherein the partitioning member substantially isolates the portions of said compartments above the bottom of said member, the bottom of said member being below the intended normal oil level in said sump area.

3. An assembly as defined in claim 1 wherein the partitioning member is hollow and defines an accumulator chamber.

4. An assembly as defined in claim 2 wherein the partitioning member is hollow and defines a suction gas accumulator chamber, a suction return line connection portion opening into the chamber from outside the housing, and suction gas ports opening laterally from the interior of the chamber into each of said compartments.

5. A hermetic multi-unit refrigeration motor-compressor assembly comprising in combination with a sealed metallic housing having top, bottom and side walls, a pair of motor-compressor units in spaced parallel relation in the housing, characterized by a partitioning member extending transversely within the housing between said units to define two compartments, each of which contains one of said units, the partitioning member being affixed to the side walls and having an accumulator chamber therein.

6. An assembly as defined in claim 5 wherein the bottom of said partitioning member is spaced above the bottom wall of the housing and the top and ends of said partitioning member are joined to the top and side walls respectively of the housing, whereby said compartments are substantially isolated from each other except in an oil sump area below the bottom of the partitioning member.

7. An assembly as defined in claim 6 including coupling portions having passage means extending through one of said walls and into the chamber in said partitioning member, and passage-defining portions extending from the interior of said chamber into each of said compartments for communication with each of said units.

8. In an assembly as defined in claim 7, passage-defining means extending from a lower portion of the chamber to said oil sump area.

9. An assembly as defined in claim 5 wherein said partitioning member comprises a hollow sheet metal enclosure having end wall portions conforming substantially to the shape of and fitted closely against the inner faces of the side walls of the housing.

10. An assembly as defined in claim 9 wherein said conforming portions of the walls of the partitioning member and housing are substantially flat.

11. A hermetic multi-unit refrigeration motor-compressor assembly comprising in combination with a sealed metallic housing having top, bottom and side walls, a pair of motor-compressor units in spaced parallel relation in the housing, characterized by a partitioning member extending transversely within the housing between said units, to define two compartments, each of which contains one of said units, the partitioning member being affixed to the side walls and top wall and containing a chamber defining an accumulator in fluid-conductive communication with both of the compressors.

12. An assembly as defined in claim 11 including a return line coupling portion leading into said chamber, and wherein said fluid-conductive communication includes openings in the partitioning member connecting the chamber to each of said compartments to permit refrigerant to flow to said compressors through the space in said compartments.

13. An assembly as defined in claim 11 including a return line coupling portion leading into said chamber and wherein each of said compressors discharges directly into said housing, said fluid-conductive communication comprising a conduit leading from said chamber to the inlet of each compressor.

14. An assembly as defined in claim 11 wherein the partitioning member is a hollow sheet metal element and said accumulator chamber is graduated to increased width toward said side walls.

15. An assembly as defined in claim 14 wherein said chamber defines a suction accumulator, and tubular fluid conductive means extending vertically within one of said chamber portions of increased width for conducting fluid from said chamber for delivery to the compressors.

16. An assembly as defined in claim 14 wherein said chamber defines a suction accumulator, a J-tube in one of said chamber portions of increased width, and tubular means connected to said J-tube for conducting fluid to each of said compressors.

* * * * *